US008724843B2

(12) United States Patent
Inoue et al.

(10) Patent No.: US 8,724,843 B2
(45) Date of Patent: May 13, 2014

(54) ELECTRODYNAMIC SOUND-EMITTING DEVICE

(75) Inventors: Satoru Inoue, Tokyo (JP); Mutsuo Sekiya, Tokyo (JP); Seiki Suzuki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 45 days.

(21) Appl. No.: 13/497,325

(22) PCT Filed: Aug. 9, 2011

(86) PCT No.: PCT/JP2011/068114

§ 371 (c)(1), (2), (4) Date: Mar. 21, 2012

(87) PCT Pub. No.: WO2013/021455

PCT Pub. Date: Feb. 14, 2013

(65) Prior Publication Data

US 2013/0039526 A1 Feb. 14, 2013

(51) Int. Cl.
*H04R 1/00* (2006.01)

(52) U.S. Cl.
USPC ..... 381/398; 181/171; 181/172

(58) Field of Classification Search
USPC ..... 381/386, 398, 403, 404, 423, 433; 181/165, 166, 171, 172
See application file for complete search history.

(56) References Cited

U.S. PATENT DOCUMENTS

| | | | | |
|---|---|---|---|---|
| 2,840,177 | A * | 6/1958 | Schoengold | 181/172 |
| 4,939,783 | A * | 7/1990 | Dunning | 381/386 |
| 5,319,718 | A * | 6/1994 | Yocum | 381/398 |
| 6,095,280 | A * | 8/2000 | Proni | 181/171 |
| 6,543,574 | B1 * | 4/2003 | Mizone et al. | 181/171 |
| 6,934,399 | B2 * | 8/2005 | Kam | 381/152 |
| 2005/0271226 | A1 * | 12/2005 | Tanabu et al. | 381/182 |
| 2008/0232635 | A1 | 9/2008 | Corynen | |
| 2010/0245069 | A1 | 9/2010 | Noro | |

FOREIGN PATENT DOCUMENTS

| | | | |
|---|---|---|---|
| EP | 2 233 373 | A1 | 9/2010 |
| JP | 68-059697 | A | 4/1983 |
| JP | 11-027810 | A | 1/1999 |
| JP | 2000-004569 | A | 1/2000 |
| JP | 2003-333692 | A | 11/2003 |
| JP | 3163061 | U | 7/2004 |
| JP | 2007-027923 | A | 2/2007 |
| JP | 2008-515326 | A | 5/2008 |
| JP | 2009-094914 | A | 4/2009 |
| JP | 2010-228564 | A | 10/2010 |

* cited by examiner

*Primary Examiner* — Curtis Kuntz
*Assistant Examiner* — Joshua A Kaufman
(74) *Attorney, Agent, or Firm* — Birch, Stewart, Kolasch & Birch, LLP

(57) ABSTRACT

A casing for covering an outer yoke is provided; an acoustic cavity is formed by this casing; a diaphragm and the outer surface of a side wall of the outer yoke; a second elastic member is provided to join the outer circumferential edge of the casing to the outer circumferential edge of the diaphragm without any gap therebetween; this second elastic member includes pores formed by foaming and made of a material whose elastic modulus is smaller than that of a first elastic member; and pores communicating through from the back surface of the second elastic member, that is the inner side of the casing, to the front surface that is the opposite side of the back surface are eliminated.

6 Claims, 8 Drawing Sheets

ELECTRODYNAMIC SOUND-EMITTING DEVICE

TECHNICAL FIELD

The present invention relates to a sound-emitting device used for an alarm sound generator for informing pedestrians, etc. around an electric moving body of its approaching or presence, and in particular to an electrodynamic sound-emitting device for generating sound using an electrodynamic exciter.

BACKGROUND ART

Following the practical development of electric bicycles and carts in recent years, transportation means serving as various kinds of moving bodies, such as electric motorcycles and electric motor vehicles, have begun to be rapidly powered by electricity. Specifically, as the replacement of motor vehicles powered by an internal combustion engine, there have been developed one after another vehicles such as hybrid vehicles powered by both gasoline engine and electric motor, electric vehicles powered by an electric motor driven by an onboard battery that is charged by a household-use power source or by a battery charger installed at gas stations or power supply stations, and fuel cell vehicles that run while generating electricity by a fuel cell using hydrogen and the like as the fuel. The electric motorcycles, hybrid vehicles and electric vehicles have already been put into practical use, and have begun rapidly becoming popular in the domestic market as well.

Since gasoline vehicles, diesel vehicles, motorcycles, etc. powered by the conventional internal combustion engine generate not only exhaust sound and engine sound which their power sources emit but also road noise in running, pedestrians, cyclists, etc. going around town streets can recognize those vehicles approaching by their engine and exhaust sound and the like. However, when running at low speed, the hybrid vehicles do not run powered by the combustion engine, but they are mainly in a running mode powered by the electric motor; therefore, no engine sound nor exhaust sound is generated, and furthermore, as for the electric vehicles and fuel cell vehicles, they run driven by the electric motor over the whole range of driving, which has made them extremely quiet electric moving bodies. However, pedestrians, cyclists, etc. who are in the vicinity of such quiet electric moving bodies as above cannot recognize by sound the approaching of the electric moving bodies, such as hybrid vehicles, electric vehicles and fuel cell vehicles, that run driven by the electric motor that generates little sound and is quiet, which therefore might cause occurrence of accidental contact of the pedestrians, etc. with those quiet electric moving bodies.

Therefore, in order to aim at resolving the foregoing problem in that quietness, which should be the advantage inherent to the hybrid vehicles, electric vehicles and fuel cell vehicles, sometimes become harmful, there have been proposed various systems other than klaxons mounted on conventional vehicles and operating following drivers' intention, that operate independently of the drivers' intention so as to give an alarm about the presence of the vehicles of their own.

For example, an electric vehicle is disclosed in Patent Document 1, which includes a running status detection means that detects and outputs a running status of the vehicle, an alarm sound generation means that emits sound to the outside based on the detected running status, and a control means that takes control of driving the alarm sound generation means, and can emit alarm sound, engine sound and the like so as to inform pedestrians around the vehicle of its approaching, and in which a klaxon and speaker are utilized as the alarm sound generator.

In addition, it is disclosed in Patent Document 2 that a vehicle, when running powered by its own electric motor, emits sound related to an audio signal so as to allow pedestrians to hear the sound and recognize the vehicle approaching. As a sound-emitting device for emitting the sound, there is disclosed a one that utilizes a speaker array made up of general cone speakers (moving magnet type).

Moreover, a piezoelectric speaker is disclosed in Patent Document 3 as a speaker system. This piezoelectric speaker is a high-impedance piezoelectric speaker in which electrodes are formed on both sides of a piezoelectric (piezoelectric element) and a sound signal is applied to the piezoelectric and which incorporates as the basic constituents a frame having a mounting flange, an elastic diaphragm, a piezoelectric diaphragm and a discoid damper. It is also disclosed that not only flat frequency characteristics can be obtained by this speaker system, but also its lower frequency limit and sound-pressure frequency characteristics can be enhanced by configuring a mechanical vibration system, so that a speaker system that also excels in performance can be provided, and so forth.

On the other hand, a vibration actuator that is mounted in mobile communications devices such as a pager (pocket bell) and mobile telephone and provided with a function of generating vibration is disclosed in Patent Document 4. In this vibration actuator, a coil is disposed in an air gap in a magnetic circuit including a permanent magnet that is fixed to its center column retaining an air gap between the damper and itself. In Patent Document 4, it is disclosed that the magnetic circuit is disposed concentrically with respect to the coil so that the coil is movably supported, the center column is provided with a stopper portion extending perpendicularly to axial directions and contacts to the damper, this stopper portion is formed stepwise and contacts to the damper, and the cross-section of which is shaped in an arc.

Moreover, in Patent Document 5 is shown a mounting structure of a panel-type speaker that vibrates the panel of a mobile telephone so as to use it as a speaker. In Patent Document 5, it is disclosed that an exciter is attached to the panel, and the panel and the casing are supported by a suspension in which a continuously-foamed material is sandwiched by a thin film, such as PET, and acrylic glue and the like. It is also disclosed that the space between the panel and casing is sealed with a waterproof film in this structure, and moisture is thereby prevented from entering there. Furthermore, it is also described that since the continuously-foamed material is used as the elastic material, sound pressure as the speaker is not lowered.

PRIOR ART DOCUMENT

Patent Document

Patent Document 1: Japanese Laid-Open Patent Publication No. H11-27810

Patent Document 2: Japanese Laid-Open Patent Publication No. 2010-228564

Patent Document 3: Japanese Laid-Open Patent Publication No. 2003-333692

Patent Document 4: Japanese Laid-Open Patent Publication No. 2000-4569

Patent Document 5: Japanese Laid-Open Patent Publication No. 2007-27923

DISCLOSURE OF THE INVENTION

Problem to be Solved by the Invention

In Patent Documents 1 and 2 described above are disclosed electric moving bodies that can emit sound such as alarm and engine sound, in order to inform pedestrians around the moving bodies of approaching of their vehicles; however it is only disclosed that a conventional klaxon or speaker is used as the sound-emitting device.

Moreover, Patent Document 3 only discloses a structure for enhancing frequency characteristics when a piezoelectric element is used as an indoor-use speaker system; therefore, the speaker system disclosed in Patent Document 3 does not have such a structure as environment resistance being taken into consideration as an alarm sound generator used for the electric moving bodies.

Furthermore, Patent Documents 4 and 5 only describe a speaker system for a mobile device such as a mobile telephone, but do not disclose any structure that enables frequency characteristics suited to generating alarm sound to be obtained while enhancing the environment resistance as an alarm sound generator used for the electric moving bodies.

The present invention has been made to resolve the foregoing problems with a conventional speaker system, and aims at providing an electrodynamic sound-emitting device that is light and thin, excels in environment resistance such as water resistance and has frequency characteristics suited to an onboard sound-emitting device in spite of its simple structure.

Means for Solving the Problem

An electrodynamic sound-emitting device according to the present invention includes an outer yoke shaped having a bottom and a side wall, a magnetic circuit having a magnet and an inner yoke disposed surrounded by the outer yoke, a coil disposed in a magnetic gap created in the magnetic circuit, a diaphragm to which the coil is fixed, and a first elastic member for elastically joining the diaphragm to the wall of the outer yoke; and the electrodynamic sound-emitting device comprises: a casing for covering the outer yoke, so as to form an acoustic cavity by this casing, the diaphragm and the outer surface of the side wall of the outer yoke; and a second elastic member for joining the outer circumferential edge of the diaphragm to the outer circumferential edge of the casing without any gap therebetween; wherein the second elastic member is provided with pores by foaming and made of a material whose elastic modulus is lower than that of the first elastic member, but is not provided with the pores that communicate through from the back surface of the second elastic member, that is the inner side of the casing, to the front surface that is the opposite side of the back surface.

Advantage of the Invention

According to the present invention, an electrodynamic sound-emitting device can be provided that is light and thin, excels in environmental resistance and has frequency characteristics suited to an on-board sound-emitting device in spite of its simple structure.

EMBODIMENTS FOR CARRYING OUT THE INVENTION

Embodiment 1

Figure 1:
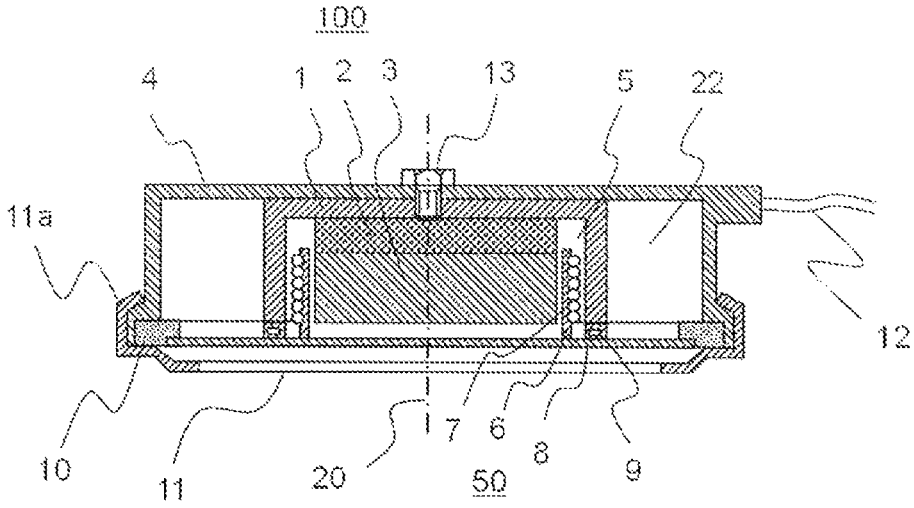
FIG. 1 is a schematic cross-sectional view showing the configuration of an electrodynamic sound-emitting device according to Embodiment 1 of the present invention.
Figure 2:
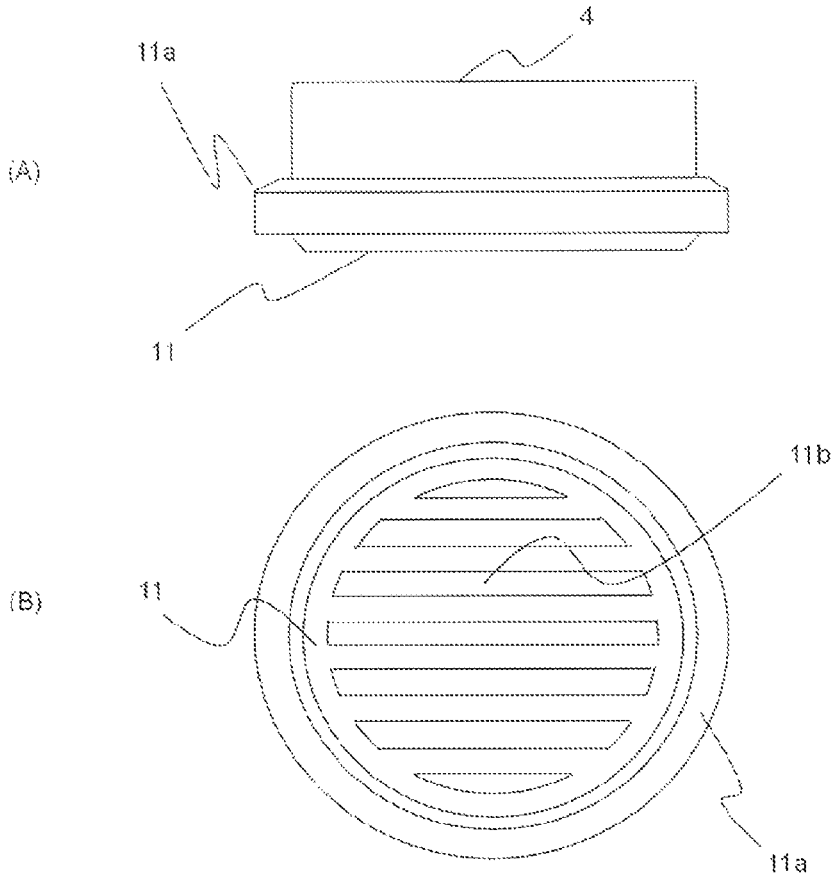
FIG. 2 is an external view of the electrodynamic sound-emitting device according to Embodiment 1 of the invention.

FIG. 1 is a schematic cross-sectional view showing the configuration of an electrodynamic sound-emitting device according to Embodiment 1 of the present invention. Moreover, FIG. 2 is an external view of the electrodynamic sound-emitting device shown in FIG. 1; FIG. 2(A) is a front view and FIG. 2(B) a bottom view. As shown in FIG. 2, the overall shape of this electrodynamic sound-emitting device is circular. In FIG. 1, one of the magnetic pole ends of a columnar magnet 2 is glued, coaxially with respect to an outer yoke 1, onto the inner side of the bottom of the outer yoke 1 that is made of magnetic material and formed in a shape having a bottom and cylindrical side wall. Moreover, a columnar inner yoke 3 made of magnetic material is glued onto the other magnetic pole end of the magnet 2, coaxially with respect to the outer yoke 1 and magnet 2. Those outer yoke 1, magnet 2 and inner yoke 3 constitute a magnetic circuit 100. The directions, shown by the dotted-dashed line in FIG. 1, of the center axis 20 of the magnetic circuit 100 including cylindrical and columnar parts are hereinafter referred to as axial directions.

A coil 7 wound on a bobbin 6 is inserted in a magnetic gap 5 that is created between the inner side wall of the outer yoke 1 and the outer circumferential surface of the inner yoke 3 in the magnetic circuit 100 and in which magnetic flux density is high. The bobbin 6 is fixed to a diaphragm 8 by gluing or by integral forming together with the diaphragm 8 using the same material; the diaphragm 8 is elastically supported by means of a first elastic member 9 by the outer yoke 1. A casing 4 is provided so as to house the outer yoke 1 thereinside; a second elastic member 10 is interposed between the diaphragm 8 and the casing 4. The outer yoke 1 is fastened to the casing 4 with a bolt 13; an acoustic cavity 22 is formed by the casing 4, the outer side wall surface of the outer yoke 1 and the diaphragm 8. Here, although the casing 4 that houses the outer yoke 1 thereinside is fixedly screwed to the outer yoke 1 at the bottom, it goes without saying that the casing 4 may be fixed to the outer yoke 1 by methods other than screwing. Moreover, a wire harness 12 for supplying a predetermined electric signal to the coil 7 from the outside is connected to the casing 4.

As shown in the external view in FIG. 2, a front cover 11 covers the front face of the diaphragm 8, whereby the diaphragm 8 is protected against splashing debris and the like, such as solid particles including tiny stones and sand on the road, from the outside. Moreover, the front cover 11 is provided with an aperture 11*b* having an aperture area opening to an extent not to shield sound from the diaphragm 8. Although FIG. 2 shows the aperture 11*b* shaped in slits, the aperture 11*b* may be formed in any shape as far as it can protect the diaphragm 8 against splashing debris and has an aperture area opening to the extent not to shield sound from the diaphragm 8.

The second elastic member 10 is made of flexible foam rubber or flexible foam resin that includes large numbers of pores by foaming processing, and is an elastic member that can be easily deformed by outside force. That is to say, the second elastic member 10 is formed of a material that has an elastic modulus smaller than that of the first elastic member 9. Moreover, the second elastic member 10 is formed in an annular shape; the inner circumferential edge thereof contacts with and supports the entire outer circumferential edge of the diaphragm 8 in a unified manner; and the outer circumferential edge of the second elastic member 10 is clamped and supported by the casing 4 and a fitting portion 11*a* of the front cover 11.

Figure 3:
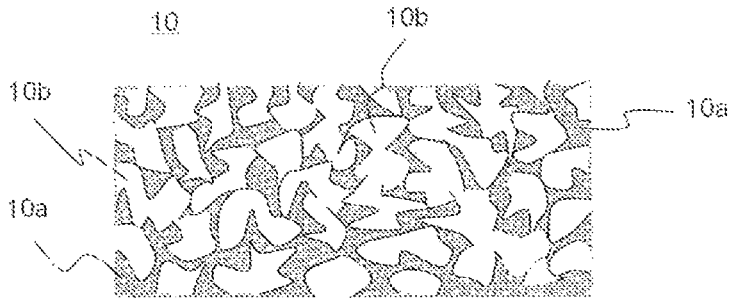
FIG. 3 is a schematic cross-sectional view showing an internal structure of a second elastic member of the electrodynamic sound-emitting device according to Embodiment 1 of the invention.

FIG. 3 is a schematic cross-sectional view for describing a cross-sectional structure of the second elastic member 10 according to Embodiment 1 of the present invention. As shown in FIG. 3, there are large numbers of pores 10*b* inside the second elastic member 10 by the foaming processing, which are surrounded by thin portions 10*a* of rubber, for example, serving as foamed base material. Incidentally, although some of walls of the pores 10*b* partially communicate with neighboring walls of the pores 10*b*, there are no such continuous pores as communicating through from the front surface to the back surface of the second elastic member 10, thereby ensuring an airtight state. Moreover, the material serving as the foamed base material includes rubber and resin; however as the second elastic member 10, the material needs to have, by the foaming processing, an elasticity that enables itself to be easily deformed by external force. As described above, the elastic modulus of the second elastic member 10 must be smaller than the elastic modulus of the first elastic member 9. This is because the vibration characteristics of the diaphragm 8 are dominantly determined by the first elastic member 9. The effect of the second elastic member 10 on the vibration characteristics is preferably at least less than half the effect of the first elastic member 9. The vibration characteristics effectively depend on the square root of the elastic modulus along an axial direction of an elastic member; therefore, the elastic modulus of the second elastic member 10 is preferably less than a quarter of the elastic modulus of the first elastic member 9.

Figure 4:
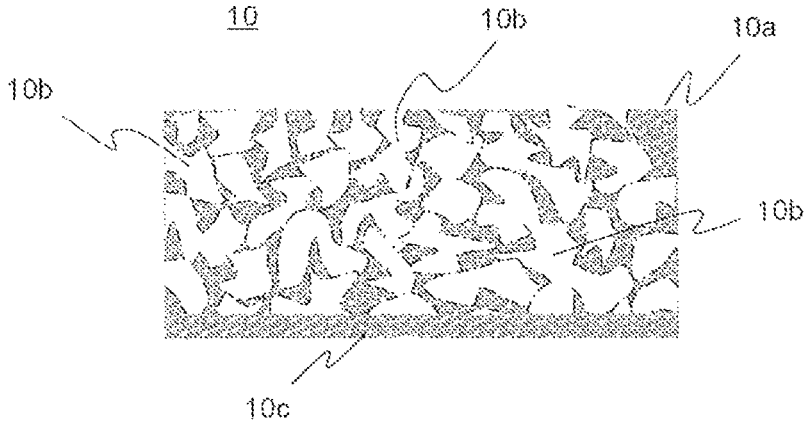
FIG. 4 is a schematic cross-sectional view showing another internal structure of the second elastic member of the electrodynamic sound-emitting device according to Embodiment 1 of the invention.

FIG. 4 is a schematic cross-sectional view for describing another example of the internal structure of the second elastic member 10 according to Embodiment 1 of the present invention. This second elastic member 10 is provided with a laminar airtight skin layer 10*c* on at least one of the surfaces thereof. In this second elastic member 10, although some of walls of the pores 10*b* partially communicate with neighboring walls of the pores 10*b*, communication to the surface is blocked off by the skin layer 10*c*; therefore, there are no such continuous pores as communicating through from the front surface to the back surface of the second elastic member 10, thereby ensuring the airtight state. Therefore, moisture can be prevented from penetrating from the outside, so that an electrodynamic sound-emitting device having excellent waterproof properties and environment resistance can be provided.

Figure 5:
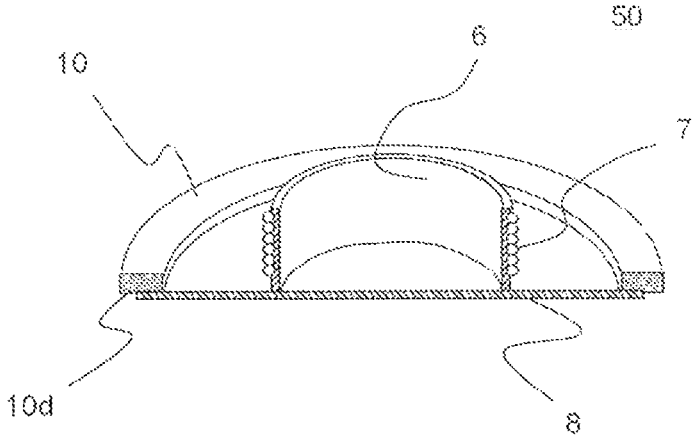
FIG. 5 is a schematic view showing the assembly configuration of a diaphragm assembly of the electrodynamic sound-emitting device according to Embodiment 1 of the invention.

FIG. 5 is a schematic view for describing an assembly structure of a diaphragm assembly 50 according to Embodiment 1 of the present invention, and is a view showing the diaphragm assembly 50 cut along a median line. The diaphragm assembly 50 is a component in which the bobbin 6 with the coil 7 wound thereon is integrally joined to the diaphragm 8 by gluing and the like. As shown in FIG. 5, the inner circumferential edge of the second annular elastic member 10 is glued on the back side (bobbin-glued side) of the outer circumferential edge of the diaphragm 8. When the second elastic member 10 having the laminar skin layer 10*c* shown in FIG. 4 is used, the surface on which the diaphragm 8 is glued is preferably the skin layer 10*c* side. Incidentally, the method of joining the second elastic member 10 to the diaphragm 8 may be gluing or welding, but is not limited to those as far as they can be joined to each other without any gap therebetween.

Figure 6:
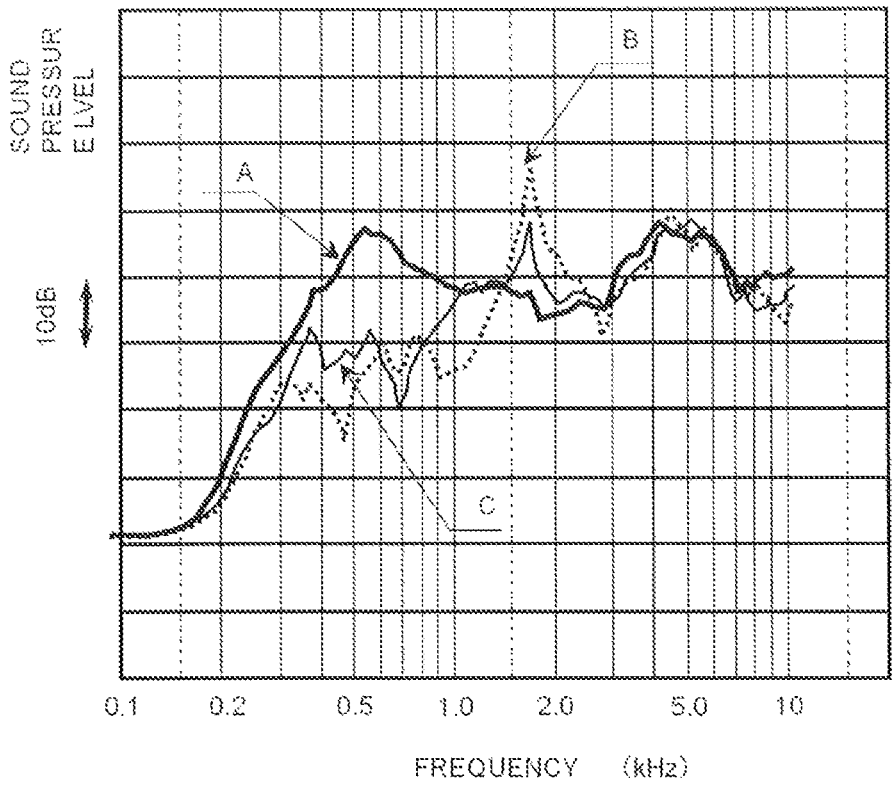
FIG. 6 is a characteristics-comparison view showing comparison of the characteristics of the electrodynamic sound-emitting device according to Embodiment 1 of the invention with the characteristics of comparison examples.

FIG. 6 is a characteristics-comparison view for describing specific acoustic effects by the foam rubber according to Embodiment 1 of the invention; in the figure, the horizontal axis represents frequency and the vertical axis, sound pressure levels. Here, the bold solid line A shows acoustic characteristics under the condition that the second elastic member 10 according to Embodiment 1 of the invention is made of airtight foam rubber. As comparison examples, the dotted-line B shows acoustic characteristics under the condition that the second elastic member 10 is not provided and a gap is therefore present between the circumferential edge of the diaphragm 8 and the casing 4; the thin solid-line C shows acoustic characteristics under the condition that the portion between the circumferential edge of the diaphragm 8 and the casing 4 is covered with a thin nylon sheet in place of the second elastic member 10 so as to eliminate the gap.

As shown in FIG. 6, significant difference can be seen in a lower frequency band near 500 Hz and a higher frequency band near 1600 Hz among the characteristics shown by the bold solid line A, the dotted-line B and the thin solid-line C. That is to say, the characteristics shown by the dotted-line B in which the gap is present in the circumferential edge of the diaphragm 8 indicate that frequency components in the lower frequency band of 500 Hz are very small, and in addition, a narrow frequency region with a very high sound pressure level is present near 1600 Hz, which seems to be attributable to self-excited resonance of the diaphragm. When pedestrians and the like around a vehicle hear such sound from a sound-emitting device as having frequency characteristics including fewer low frequency components and more high frequency components, the sound quality will be so high-pitched that they feel unpleasant; therefore a sound-emitting device having such frequency characteristics is not suited to a vehicle-approach-alarming device for electric vehicles, etc.

Moreover, in the frequency characteristics shown by the thin solid-line C under the condition that the nylon sheet is laid, the frequency peak at 1600 Hz that seems to be attributable to the self-excited resonance becomes slightly lower, and compared to the dotted-line B in which the gap is present, characteristics in a frequency band between 300 Hz and 600 Hz are slightly raised; however so significant improvement cannot be seen, and from a sound quality point of view, this is not so suited to a vehicle-approach-alarming device for electric vehicles, etc.

Compared to those, the sound pressure level in the frequency band near 500 Hz has been greatly increased in the characteristics shown by the bold solid line A under the condition that the airtight foam rubber according to Embodiment 1 of the invention is used. That is to say, in a wide frequency band from 300 Hz in the low frequency band to 1000 Hz, the sound pressure level has been greatly increased compare to the comparison examples, and even a maximum improvement result of 20 dB can be seen in some frequency ranges. Moreover, the sound pressure level near 1600 Hz, which seems to be attributable to the self-excited resonance, has been greatly attenuated, and does not demonstrate frequency characteristics having any narrow peak. As described above, the frequency characteristics having the frequency peak in the high frequency range have disappeared, as well as the sound pressure level in the low frequency range has been greatly raised, whereby a sound-emitting device whose sound pressure demonstrates almost flat frequency characteristics over a range from 500 Hz to 3000 Hz can be provided.

A sound-emitting device having flat frequency characteristics, capable of generating sound in a constant sound pressure level over from lower to higher frequencies emits very soft quality sound, and the sound easily reaches pedestrians relatively far in the distance. For that reason, the present invention can not only improve the sound quality, but also improve in recognition by pedestrians; therefore, this can provide preferable frequency characteristics as a sound-emitting device used for a vehicle-approach-alarming device for quiet electric vehicles, etc.

According to an electrodynamic sound-emitting device of this Embodiment 1, no gap is created between the diaphragm 8 and the casing 4, so that the acoustic cavity 22 behind the diaphragm 8 can be retained nearly in the airtight state. Therefore, compared to the case in which the gap is present, the cavity behind the diaphragm 8 can act more effectively as an acoustic cavity. Thereby, emitting sound pressure can be enhanced in an acoustic frequency band depending on the acoustic volume of the acoustic cavity 22, so that a more efficient electrodynamic sound-emitting device can be provided.

Furthermore, since some of the large numbers of pores scattered in the second elastic member 10 communicate with neighboring pores, air in certain pores communicates with that in other pores or in the back side of the second elastic member 10. Therefore, when pressed by the diaphragm 8, the second elastic member 10 is compressed and deformed by very small pressing force, so that the elastic modulus of the second elastic member 10 can be made much smaller compared to the first elastic member 9. Thereby, the vibration characteristics of the diaphragm 8 can be set to be determined by the first elastic member 9 without the vibration characteristics of diaphragm 8 being affected by the second elastic member 10, so that the effect of the second elastic member 10 on the vibration amplitude of the diaphragm 8 can be minimized. Moreover, neighboring pores in the second elastic member 10 are partitioned off from one another by soft thin walls that can be easily deformed; therefore, part of air vibration energy transmitted into the pores is consumed as energy for vibrating the thin walls, thereby bringing about sound absorbing effects. Furthermore, since no air passes through between the front surface and back surface of the second elastic member 10, the cavity formed by the back surface of the diaphragm 8 and the casing 4 acoustically acts as the acoustic cavity 22, so that the lower frequency characteristics required for the sound-emitting device can be enhanced. In addition, there are no continuous pores communicating through from the front surface to the back surface of the second elastic member 10 and the airtight state is retained, so that an electrodynamic sound-emitting device having excellent waterproof properties and environment resistance can be provided.

Embodiment 2

Figure 7:
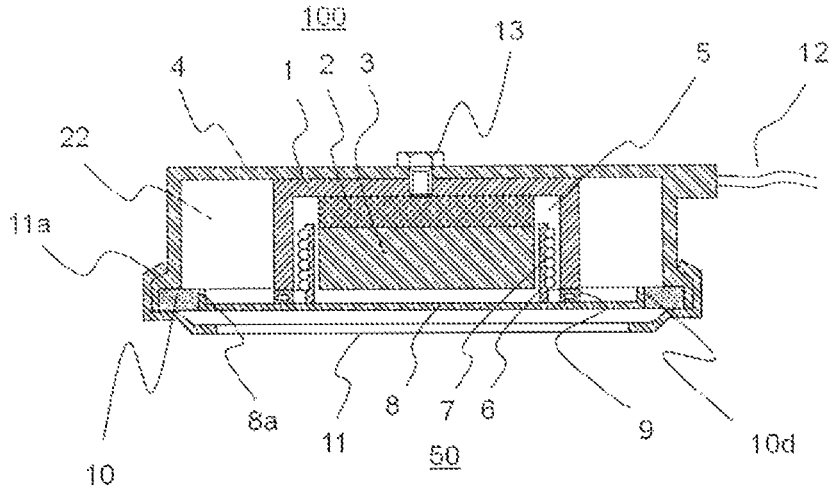
FIG. 7 is a schematic cross-sectional view showing the configuration of an electrodynamic sound-emitting device according to Embodiment 2 of the invention.

FIG. 7 is a schematic cross-sectional view showing the configuration of an electrodynamic sound-emitting device according to Embodiment 2 of the present invention; the same reference numerals as those in FIG. 1 represent the same or corresponding portions. In this Embodiment 2, a flange 8*a* extending in an axial direction is provided by bending, for example, along the outer circumferential edge of the diaphragm 8. The outer circumferential surface of this flange 8*a* and the inner circumferential surface of the annular second elastic member 10 serve as a gluing portion 10*d*, on which both are glued and fixed to each other. Moreover, the outer circumferential edge of the second elastic member 10 is clamped and supported by the casing 4 and the fitting portion 11*a* of the front cover 11.

Incidentally, the same as Embodiment 1, the second elastic member 10 is made of flexible foam rubber or flexible foam resin including large numbers of pores by the foaming processing, which therefore is an elastic member that can be easily deformed by external force and has no continuous pores communicating through from the front surface to the back surface thereof.

Figure 8:
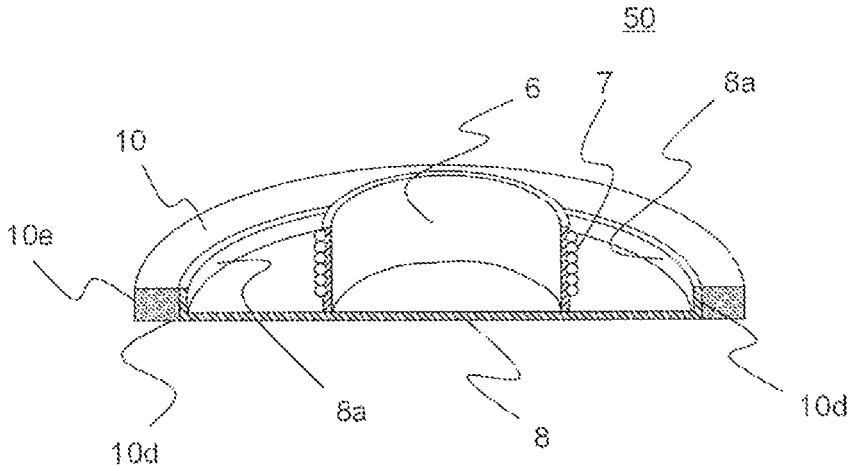
FIG. 8 is a schematic view showing the assembly configuration of a diaphragm assembly of the electrodynamic sound-emitting device according to Embodiment 2 of the invention.

FIG. 8 is a schematic view of an assembly structure of a diaphragm assembly 50 of the electrodynamic sound-emitting device according to Embodiment 2 of the invention. The diaphragm assembly 50, in which the bobbin 6 with the coil 7 wound thereon is integrally joined by gluing and the like to the diaphragm 8, is provided with the axially-extending flange 8*a* along the outer circumferential edge of the diaphragm 8. The inner side wall of the annular second elastic member 10 is glued and fixed to the outer circumferential surface of the flange 8*a* of the diaphragm 8.

Incidentally, in the diaphragm assembly 50 shown in FIG. 8, although the flange 8*a* provided along the outer circumferential edge of the diaphragm 8 is extended in one of the axial directions, it goes without saying that the flange may be extended in both axial directions. Moreover, the method of joining the second elastic member 10 to the diaphragm 8 may be gluing or welding, but not particularly limited to those as far as they can be joined to each other without any gap therebetween. Furthermore, the outer circumferential surface 10*e* of the second elastic member 10 and the inner circumferential surface of the casing 4 may be glued or welded with each other.

According to the electrodynamic sound-emitting device of this Embodiment 2, the outer wall of the axially-extending flange 8*a* along the outer circumferential edge of the diaphragm 8 contacts with the inner wall of the annular second elastic member 10 without any gap. In addition, the outer circumferential edge of the annular second elastic member 10 is pressingly retained by the casing 4 and the front cover 11; therefore air flow between the acoustic cavity 22 behind the diaphragm 8 and the atmosphere can be easily blocked off. Moreover, when the sound-emitting device is assembled, the diaphragm assembly 50 is assembled to the casing 4 with the second elastic member 10 glued to the diaphragm 8 and retained, and after that the front cover is fitted on, whereby the second elastic member 10 disposed at the circumferential edge of the diaphragm assembly 50 can be pressingly retained easily and securely. Therefore, assembling of the second elastic member 10 becomes very easy, so that productivity in assembling the sound-emitting device can be greatly enhanced.

Embodiment 3

Figure 9:
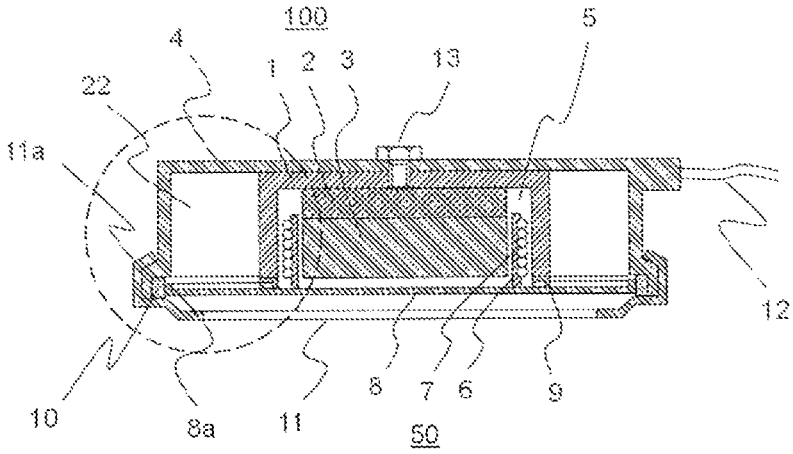
FIG. 9 is a schematic cross-sectional view showing the configuration of an electrodynamic sound-emitting device according to Embodiment 3 of the invention.
Figure 10:
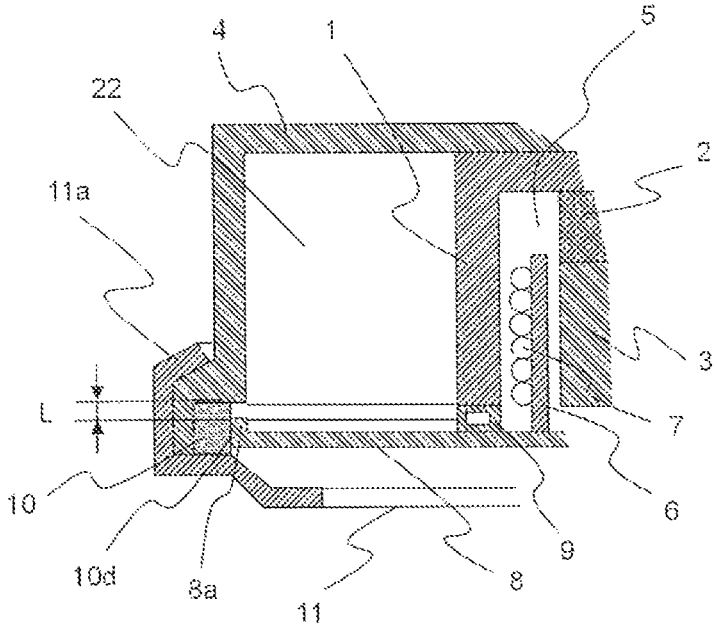
FIG. 10 is a schematic enlarged cross-sectional view showing a configuration of the essential part of the electrodynamic sound-emitting device according to Embodiment 3 of the invention.

FIG. 9 and FIG. 10 each are a schematic cross-sectional view showing the configuration of an electrodynamic sound-emitting device according to Embodiment 3 of the present invention; in the figure, the same reference numerals as those in FIG. 1 and FIG. 7 represent the same or corresponding portions. The outer circumferential surface of the flange 8*a* extending in an axial direction along the outer circumferential edge of the diaphragm 8 and the inner circumferential surface of the annular second elastic member 10 serve as the gluing portion 10*d*, on which both are glued and fixed with each other, and furthermore the outer circumferential edge of the annular second elastic member 10 is clamped and supported by the fitting portion 11*a* of the casing 4 and the front cover 11.

Incidentally, the second elastic member 10, the same as Embodiments 1 and 2, is made of flexible foam rubber or flexible foam resin including large numbers of pores by the foaming processing, which is therefore an elastic member that can be easily deformed by external force.

FIG. 10 is a schematic enlarged view in which the portion encircled by the dotted-line in FIG. 9 is enlarged. The flange 8*a* of the diaphragm 8 is set shorter than the thickness of the second elastic member 10, and the outer diameter of the flange 8*a* extending in the axial direction along the circumferential edge of the diaphragm is set greater than the inner diameter of the casing 4.

The coil 7 wound on the bobbin 6 is fixed and supported by the outer yoke 1 or the first elastic member 9 and the like, passes therethrough in this state, and in most cases connected via the casing 4 to an external control unit by the wire harness 12 or a not shown connector and the like, which is not shown in the figure. In addition, since a thin wire with a diameter of some 0.5 mm is often used for the coil 7, if the vibration amplitude of the diaphragm 8 becomes greater exceeding a predetermined value, disconnection failure is likely to occur at the connecting and fixing points of the coil 7.

Therefore, when the diaphragm 8 is displaced axially exceeding the predetermined value from any cause, a structure is required that enables the axial end surface of the flange 8*a* to contact with the casing 4 so as to restrict occurrence of the displacement exceeding the predetermined value. Specifically saying, when the diaphragm 8 directly undergoes vehicle running wind from the front cover 11 side, for example, if a pressure exceeding the withstanding strength of the first elastic member 9 that elastically supports the diaphragm 8 is exerted, the whole of the diaphragm 8 is displaced in the axial direction, and if the pressure by the running wind further increases so that the diaphragm 8 is displaced by the distance L shown in the figure, the diaphragm contacts with the casing 4.

Therefore, if an excessive pressure is applied from any cause to the diaphragm 8 from the front cover 11 side, the diaphragm is displaced by the maximum distance of L and then contacts with the casing, and after that, its further displacement can be prevented. As a result, the coil 7 wound on the bobbin 6 is not displaced to such an extent as leading to wire disconnection, so that failure due to disconnection of the coil 7 can be prevented.

The portion at which the outer diameter of the flange extending in the axial direction along the circumferential edge of the diaphragm is set greater than the inner diameter of the casing 4 does not need to extend over the whole of the circumference, but this dimensional relation only has to be maintained in part of the circumference. The reason for that is as follows: part of the flange 8*a* contacts with the casing 4, whereby the diaphragm 8 is not displaced any longer, and thereby the amount of displacement of the diaphragm 8 can be limited.

However, in the structure described in FIG. 10, if a pressure exceeding a predetermined value acts on the diaphragm 8, the end surface of the flange 8*a* of the diaphragm 8 directly collides with the casing 4; therefore, occurrence of troubles such as breakage and abnormal sound due to collision vibration is also expected.

Figure 11:
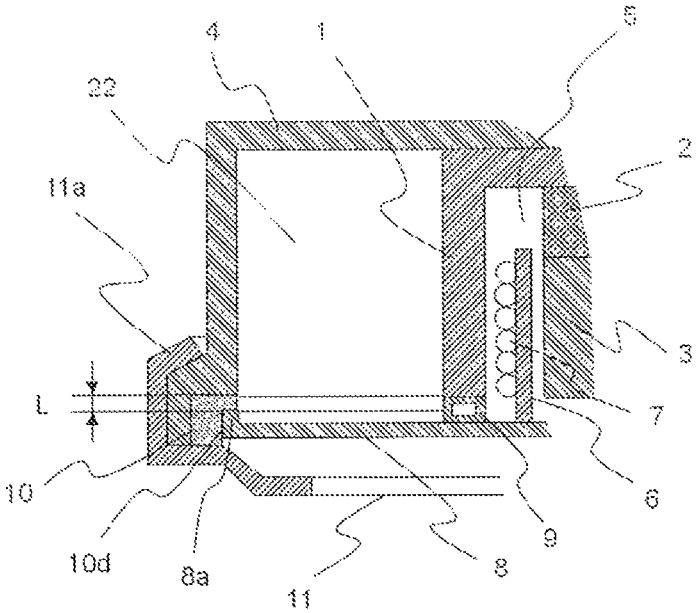
FIG. 11 is a schematic enlarged cross-sectional view showing another configuration of the essential part of the electrodynamic sound-emitting device according to Embodiment 3 of the invention.

FIG. 11 is a view for describing another structural example of the electrodynamic sound-emitting device according to Embodiment 3 of the invention, and is a schematic enlarged view of the portion corresponding to the encircled portion in FIG. 9. Here, the inner circumferential surface of the annular second elastic member 10 is glued or joined to the outer circumferential surface of the flange 8*a* that is provided along the outer circumferential edge of the diaphragm 8. Moreover, the flange 8*a* of the diaphragm 8 is set shorter than the thickness of the second elastic member 10, and part of the second elastic member 10 is shaped in such a way that it can cover the axial end of the flange 8*a*. Moreover, the outer diameter of a part of or the whole of the flange 8*a* extending in the axial direction along the circumferential edge of the diaphragm 8 is set greater than the inner diameter of the casing 4.

In the electrodynamic sound-emitting device structured shown in FIG. 11, even if the diaphragm 8 is displaced by external force such as wind pressure, exceeding the predetermined value, the end surface of the flange 8*a* does not directly contact with the casing 4, but contacts via the second elastic member 10; therefore, generation of the collision sound can be suppressed to a great extent.

DESCRIPTION OF THE REFERENCE NUMERALS

1: outer yoke
2: magnet
3: inner yoke
4: casing
5: magnetic gap
6: bobbin
7: coil
8: diaphragm
9: first elastic member
10: second elastic member
10*b*: pores
10*c*: skin layer
11: front cover
11*a*: front cover fitting portion
11*b*: aperture
12: wire harness
22: acoustic cavity
100: magnetic circuit

The invention claimed is:

1. An electrodynamic sound-emitting device including an outer yoke shaped having a bottom and a side wall, a magnetic circuit having a magnet and an inner yoke disposed surrounded by the outer yoke, a coil disposed in a magnetic gap configured in the magnetic circuit, a diaphragm to which the coil is fixed, and a first elastic member for elastically joining the diaphragm to the side wall of the outer yoke, the electrodynamic sound-emitting device comprising:

a casing for covering the outer yoke, so as to form a cavity by this casing, the diaphragm and an outer surface of the side wall of the outer yoke; and a second elastic member for joining an inner circumferential edge of the casing to an outer circumferential edge of the diaphragm without any gap therebetween; wherein this second elastic member is provided with pores by foaming and made of a material whose elastic modulus is lower than that of the first elastic member, but is not provided with the pores communicating through from a back surface of the second elastic member, that is an inner side of the casing, to a front surface that is the opposite side of this back surface, wherein the second elastic member is annular, a flange is provided along the circumferential edge of the diaphragm, extending in an axial direction of the magnetic circuit, and an outer circumferential surface of the flange and an annular inner circumferential surface of the second elastic member are joined to each other.

2. An electrodynamic sound-emitting device according to claim 1, the second elastic member is provided with an airtight laminar skin layer all over the front surface or the back surface thereof.

3. An electrodynamic sound-emitting device according to claim 1, further comprising a front cover for covering the diaphragm, having an aperture through which sound generated by the diaphragm passes, wherein a circumferential edge of the front cover and the circumferential edge of the casing are fixed by fitting with each other, and an outer circumferential edge of the second elastic member is clamped together with the fitting portion.

4. An electrodynamic sound-emitting device according to claim 1, wherein the second elastic member is made of foam rubber.

5. An electrodynamic sound-emitting device according to claim 1, wherein the thickness of the annular second elastic member is set greater than the axial dimension of the flange of the diaphragm so that at least part of an outer circumference of the flange can contact with an inner circumference of the casing by displacement of the diaphragm.

6. An electrodynamic sound-emitting device according to claim 5, wherein at least part of the second elastic member located in a portion that is dimensionally structured to enable at least part of the outer circumference of the flange to contact with the inner circumference of the fitting portion by the displacement of the diaphragm is provided so as to interpose between an axial end of the flange and the casing.

* * * * *